United States Patent [19]

Wright

[11] 3,956,798

[45] May 18, 1976

[54] FLEXIBLE BINDING

[76] Inventor: John S. Wright, 6143 N. 60th St., Milwaukee, Wis. 53218

[22] Filed: Jan. 6, 1975

[21] Appl. No.: 538,764

Related U.S. Application Data

[63] Continuation-in-part of Ser. No. 420,102, Nov. 29, 1973, abandoned.

[52] U.S. Cl. ..... 24/153 R; 281/21 A; 402/8

[51] Int. Cl.[2] ..... B42F 3/00

[58] Field of Search ..... 24/16 PB, 153 BP, 153 R, 24/206 A, 30.5 P, 17 AP, 67 AR, 67 R, 150 FP; 402/8; 281/21 A, 25 A, 36

[56] References Cited

UNITED STATES PATENTS

| | | | |
|---|---|---|---|
| 1,544,507 | 6/1925 | Van Bibber | 24/67 AR X |
| 1,829,613 | 10/1931 | Sato | 24/17 AP X |
| 2,014,973 | 9/1935 | Martling | 281/21 A |
| 2,202,097 | 5/1940 | Farkas | 281/21 A |
| 2,210,106 | 8/1940 | Tauber | 281/21 A X |
| 2,329,786 | 9/1943 | Ringler | 402/8 |
| 2,380,780 | 7/1945 | Novak | 402/8 UX |
| 2,407,656 | 9/1946 | Emmer | 281/21 A |
| 3,074,133 | 1/1963 | Jones | 24/153 BP X |
| 3,118,689 | 1/1964 | Jones | 281/36 |
| 3,362,411 | 1/1968 | Moller | 24/16 PB X |
| 3,754,304 | 8/1983 | Modrey | 24/150 FP X |

FOREIGN PATENTS OR APPLICATIONS

| | | | |
|---|---|---|---|
| 753,420 | 10/1951 | Germany | 24/16 PB |
| 690,353 | 4/1953 | United Kingdom | 281/21 A |

*Primary Examiner*—Donald A. Griffin
*Attorney, Agent, or Firm*—Quarles & Brady

[57] ABSTRACT

A flexible binding blank is die-cut from a sheet of polyethylene terephthalate to form a tape with bands projecting at right angles from one edge. In one embodiment, the tape has a perforated longitudinal center line with rectangular apertures opposite each band, and a coating of pressure sensitive adhesive. The bands are threaded through apertures in a stack of pages, and folded back so that free ends of the bands project through the rectangular apertures. In one embodiment, the tape is folded along its perforated center line securing the bands into rings, and projecting free ends cut off. In another embodiment, the bands are notched to engage notches in the tape.

5 Claims, 9 Drawing Figures

Fig. 1
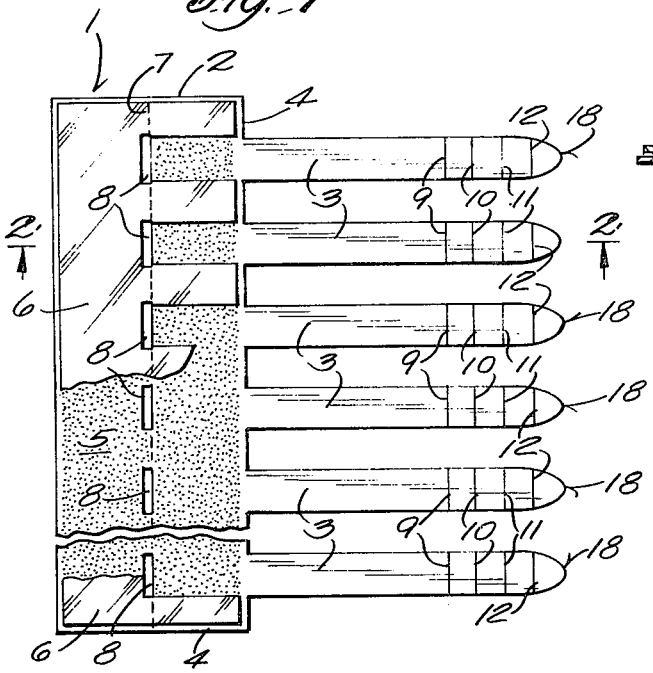
Fig. 2
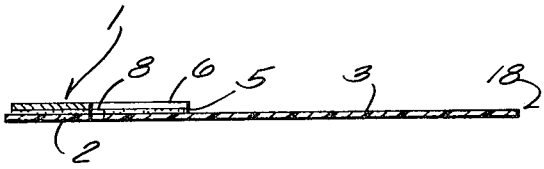
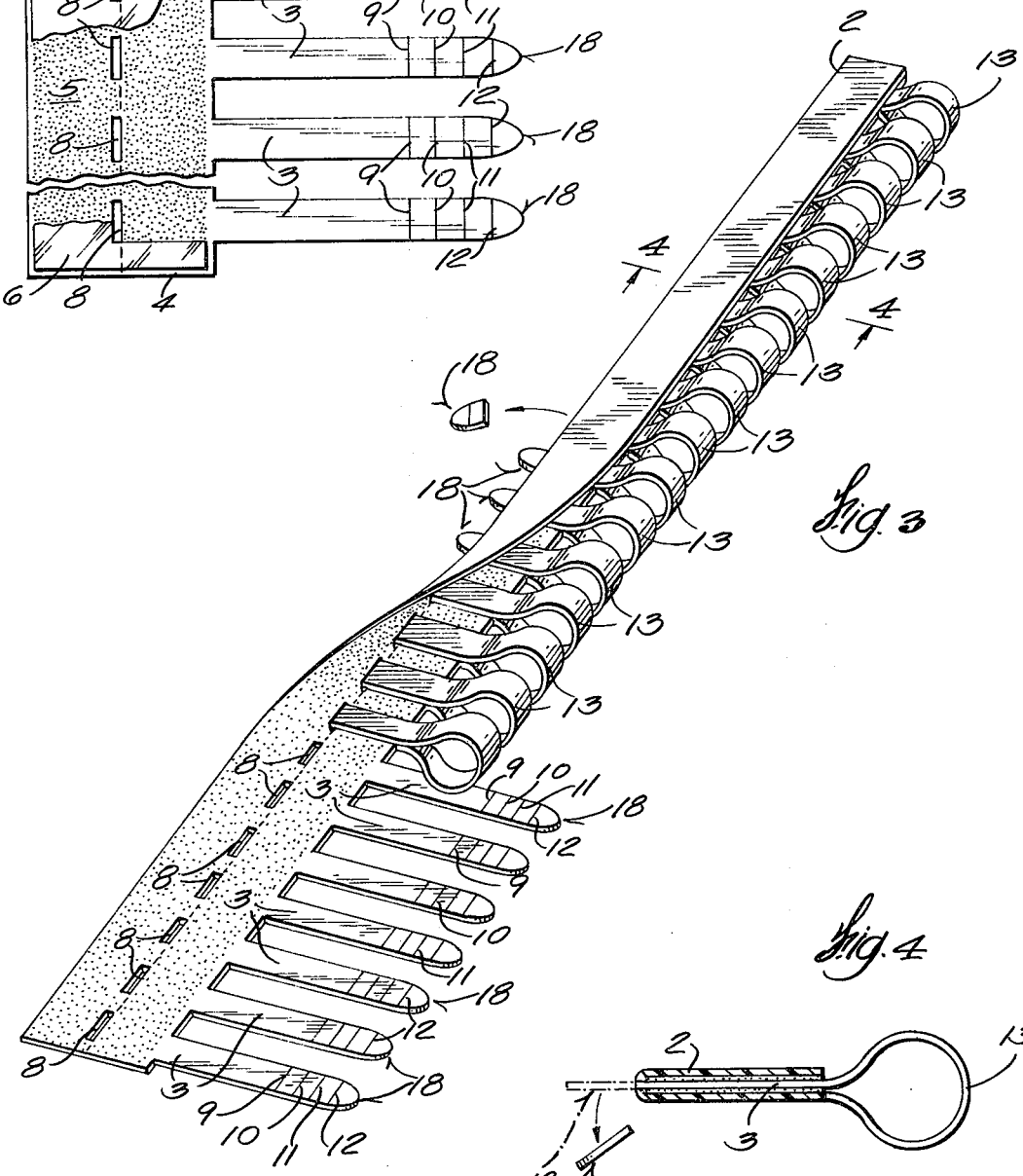
Fig. 3
Fig. 4
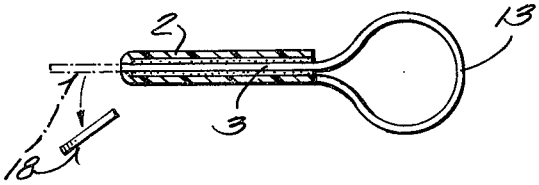

FLEXIBLE BINDING

CROSS REFERENCE TO RELATED APPLICATION

This is a continuation-in-part application of the copending application of the same inventor, Ser. No. 420,102 filed on Nov. 29, 1973 and abandoned after the filing of this continuation-in-part application.

BACKGROUND OF THE INVENTION

The art of binding pages together has evolved from the days of the Roman codex, to the present, when we have binding techniques ranging from hand sewn bindings, machine sewn bindings, the perfect or glued binding, spiral loose-leaf ring bindings, and plastic loose-leaf ring bindings to a simple stapled binding. Sewn bindings, and to a lesser extent the perfect binding are valued for their permanence, although the pages will not lie flat and the binding requires such tools and skills that it is practical only on a commercial basis. The spiral and plastic ring binding allows the pages to lie perfectly flat and requires relatively little skill, but to work the rings or spiral must be round and hence these bindings are vulnerable to crushing which either breaks or bends them rendering them unusable, and furthermore such bindings require a substantial amount of equipment. Stapled bindings, of course, are most difficult to manipulate, the least permanent of all bindings, and the simplest and least expensive.

Thus, after two millennia the need still remained for a binding that would allow the pages to lie flat and require little skill, like the spiral or ring binder, and that would be permanent, invulnerable to crushing, and would lie flat in a mailing container like the sewn and perfect bindings. And as important as all of those features are, such a binding would also need to be capable of binding of any number of pages together, like the sewn or perfect bindings and require as little special equipment, training or skills as a stapled binding, so that it could be made on either a do-it-yourself, or a commercial basis, or on a single or a mass produced basis. It is the object of the present invention to provide such a binding capable of achieving all of those objectives.

SUMMARY OF THE INVENTION

The present invention relates to a binding means for binding a plurality of pages together along an edge to form a book; more specifically, the present invention relates to the combination of a tape flexible material to extend along the edge of the pages to be bound; together with at least one band of soft flexible sheet material that extends substantially transversely of and from said tape and said edge of said pages; said band being of a supple polymeric sheet material having a high tensile strength; and with a bonding means for bonding ends of said band together to said tape to form at least one soft flexible closed ring for binding edges of pages together.

A binding made according to the foregoing invention is permanent, allows the pages to lie flat, invulnerable to crushing and hence consumes a minimum amount of space in a shipping container, and simple and inexpensive to make. A binding according to this invention may be made from a simple inexpensive kit of materials sold in grocery stores for home use, and it may also be mass produced in a highly automated factory. Moreover, a single blank may be used to provide rings of a broad range of sizes so as to be readily adapted to bind virtually any number of pages together just like a hand sewn binding, whereas a rigid ring or spiral binding is not so adaptable. The pages are held with greater tenacity and less vulnerability to tearing loose than is the case with a conventional, rigid plastic ring binder, and at the same time it has all of the advantages of such a binder. The bonding of the ends of the bands to form rings may be permanent, as with an adhesive, or it may be a mechanical bond that can be opened repeatedly and closed again to allow the pages to be added or removed. These objects and advantages of the present invention are made more evident and applications of them are illustrated in the detailed description of the preferred embodiment to follow.

BRIEF DESCRIPTION OF THE DRAWINGS

In the drawings,

FIG. 1 is a plan view of a blank of one preferred embodiment of the present invention;

FIG. 2 is a cross sectional view of the embodiment shown in FIG. 1 taken along the line 2—2 in FIG. 1;

FIG. 3 is an isometric view of the blank shown in FIG. 1 with portions in successive stages of formation into a binding without pages;

FIG. 4 is a view in section taken along the line 4—4 in FIG. 3 illustrating a completed binding without pages;

DETAILED DESCRIPTION OF THE PREFERRED EMBODIMENT

Figure 5:
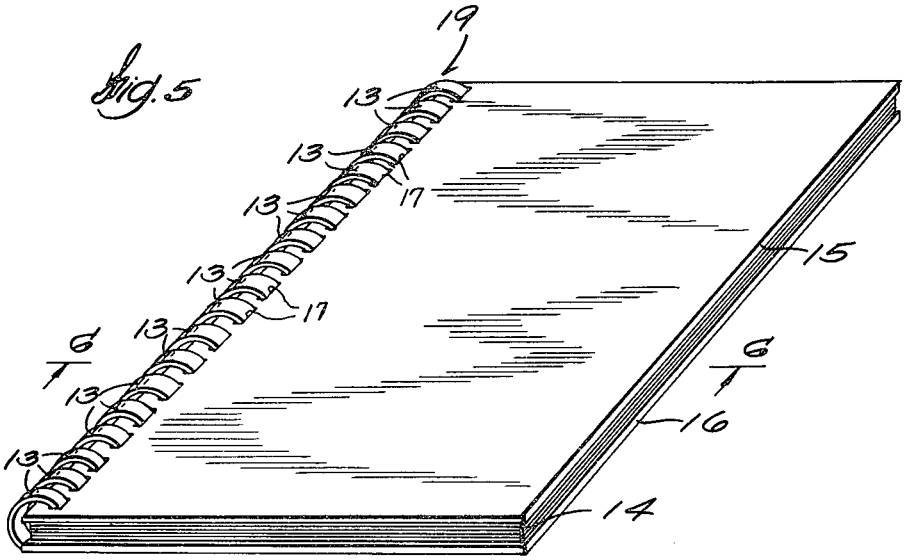
FIG. 5 is an illustration of the embodiment shown in FIG. 4 completed as a binding of a book with covers and pages.

FIG. 1 illustrates a blank 1 of plastic sheet material formed and coated for use in making a binding according to the present invention. The blank 1 is made up of a tape 2 that is intended to extend along an edge of a stack of pages to be bound together and a plurality of bands 3 that project from one edge of the tape 1, parallel to one another and normal to or transverse of the longitudinal access of the tape 2 and, therefore, to the edge of the stack of pages also. The tape 2 is coated, on its inner surface 4 with a pressure sensitive adhesive 5, which is covered with a release coated liner 6.

In this preferred embodiment of the invention, the blank 1 is die-cut from a single sheet of 0.0050 polymeric material such as polyethylene terephthalate which is more commonly known by its trade name "Mylar", with the result that the bands 3 are contiguous with the tape 2 and both are of the same material. However, for the purposes of the invention it is not essential that the blank 1 be thus constructed, for the tape 2 may be of an entirely different material from the bands 3 and the bands 3 may be detached from the tape 2 prior to final assembly of the binding. Finally, it should be noted that the invention may be practiced with but a single band 3 and a tape 2, even though it is anticipated that the most common and preferable use will employ a plurality of bands 3. The nature of the binding desired and the length of the binding will dictate the number and dimensions of the bands 3 employed as well as the dimensions of the tape 2.

Aligned on a central longitudinal axis 7 are a plurality of rectangular apertures 8, which are also aligned with the bands 3, so that each band 3 has an aperture 8 through which the free end of it may be inserted. Also, each of the bands 3 has four printed or die-marked transverse guide lines 9, 10, 11 and 12. The central axis 7 is a perforated line 7 to provide a fold line 7 for the tape 2, which due to the nature of sheet polyethylene terephthalate resists creasing, and hence requires for convenient use a perforation or other weakening. The transverse guide lines 9 through 12 serve to tell the user, first, the length of band 3 required for the desired ring size and second, insure that when the bands are formed into rings individually and manually, the rings will uniformly be of the proper size. The transverse lines 9 through 12 cooperate with the apertures 8 to guide the user in forming the binding to achieve perfect uniformity. However, it deserves emphasis that this preferred embodiment is not the only possible embodiment, and in lieu of a printed or die-marked line punched holes may be used as markers, or if but one size ring is desired, both the markers and 9—12 and the apertures 8 may be eliminated, or if the bands 3 are trimmed before being looped into a ring, even the apertures 8 may be eliminated.

To use the binding blank the user first determines the size of band rings 13 needed for the number of pages he wishes to bind together, of the preferred embodiment. The user next removes the portions of the release coated liner 6 that cover the pressure sinsitive adhesive strip 5 between the ends of the bands 3 and the corresponding apertures 8 so as to uncover those portions of the pressure sensitive adhesive 5. Then the user folds the band 3 over on itself inserting the free end, which in this embodiment is tapered, through the aperture 8 the desired amount to produce a band ring 13 of the predetermined size, by inserting end portions 18 of the band 3 through the apertures 8 until the appropriate transverse guide line 9 or 10 or 11 or 12 emerges through the aperture 8 at the back of the tape 2 to produce the predetermined band ring 13 size. Then the band 3 is pressed against the pressure sensitive adhesive 5 to stabilize the band 3 in the proper position and the remainder of the release coated liner strip 6 is removed from the pressure sensitive adhesive 5 on the inner surface of the tape 2 and the tape 2 is folded over the doubled-over bands 3 securing these bands in place in the form of the completed band rings 13 shown at the upper end of FIG. 3. Finally, the unused end portions 18 of the bands 3 which extend from the apertures 8, are cut off with an ordinary scissors leaving the completed binder.

Figure 8:
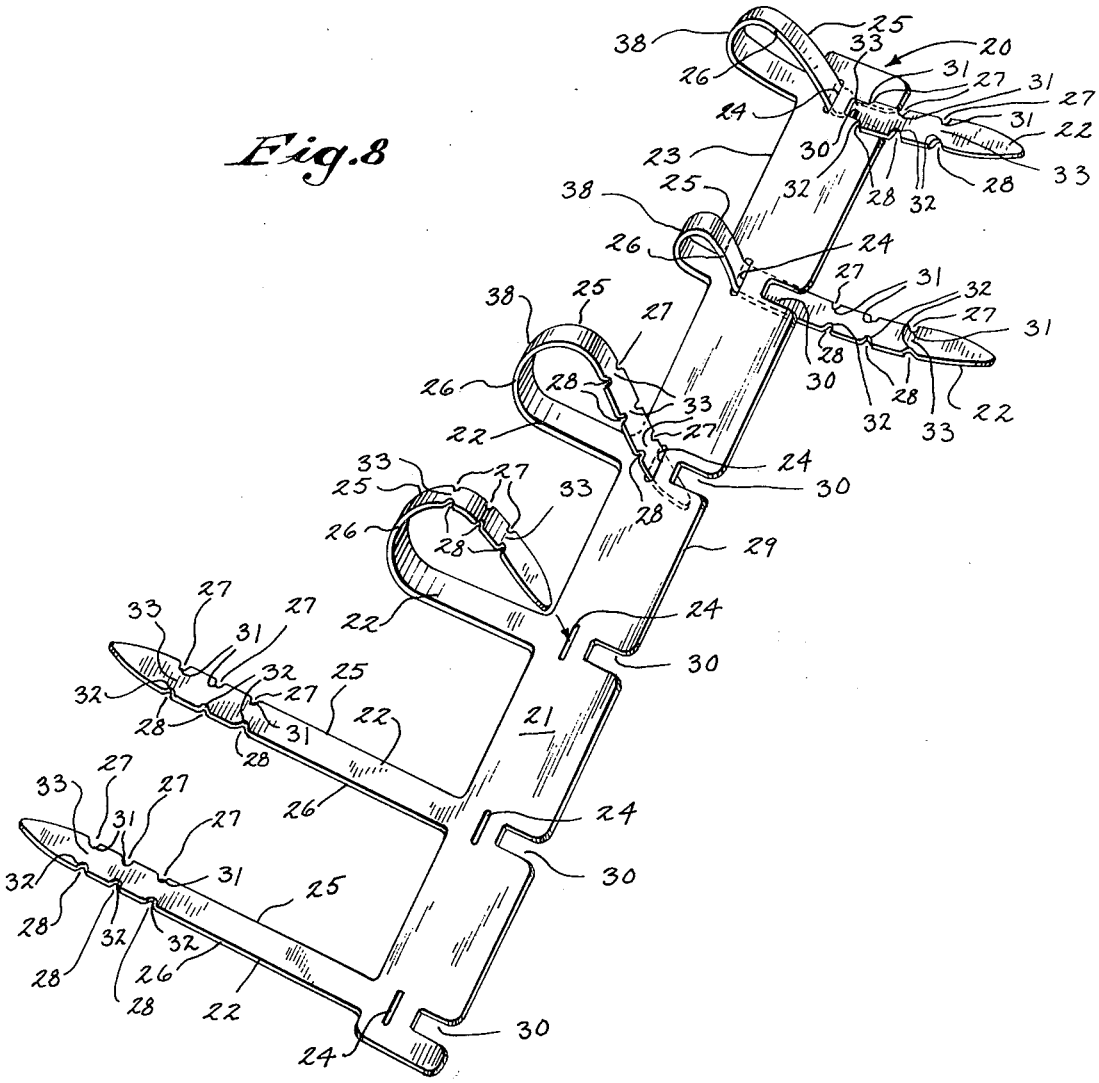
FIG. 8 is an isometric view of a blank for a second embodiment showing the steps in the formation of the rings.
Figure 9:
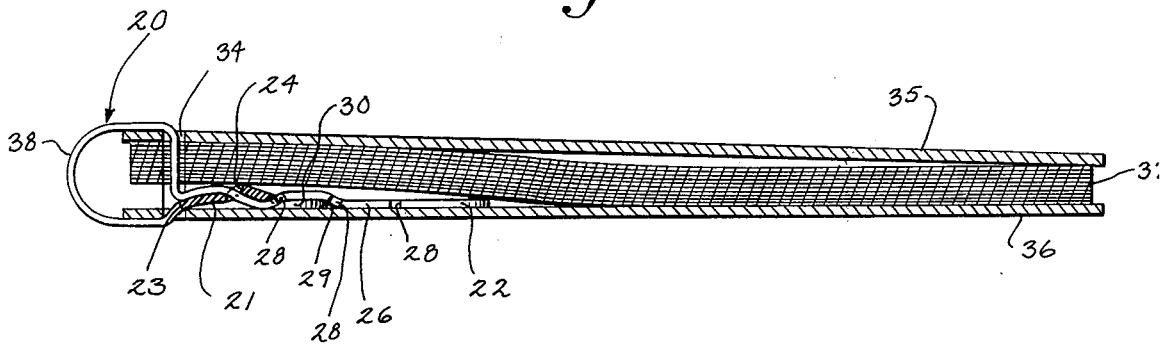
FIG. 9 is a view in section of the second embodiment used to bind the pages and covers of a book together.

The adhesive 5 is of such strength that the folded over tape 2 can no longer be separated under normal conditions and use, nor can the band rings 13 be pulled free. In this context, it should be mentioned that in lieu of a pressure sensitive adhesive 5, a heat sensitive adhesive may be used, or a coating with a material that fuses with heat can be used to achieve a heat seal, and although it may not be practical to do so, a slower drying adhesive may be applied and allowed to dry, or the tape 2 may even be stapled over the ends of the band rings 13. A second embodiment of the invention, which is shown in FIGS. 8 and 9, and discussed in detail infra., would employ neither adhesives nor staples, but would shape the bands to have alternate constricted and wide areas, as for example would result if the edges were serrated or notched and the apertures would be as wide as the widest width, but notches are formed in the tape as wide as the narrowest width so as to hold the bands 3. Also, the tape might be formed with tongues to fit through apertures (not shown) in the bands to lock the bands into band rings. The important end result is that the band rings are continuous and cannot be pulled apart.

Figure 6:
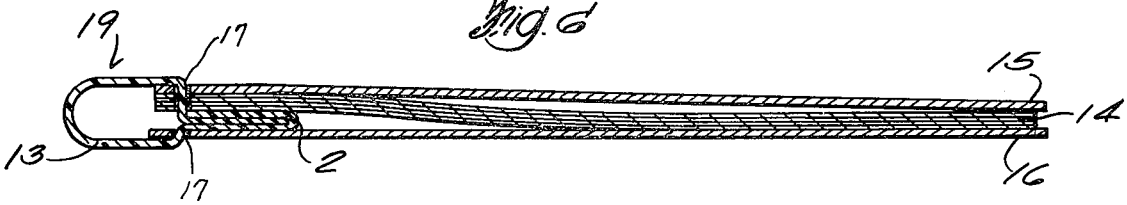
FIG. 6 is a cross sectional view of the book and binding shown in FIG. 5 taken along the line 6—6 in FIG. 5.

To produce the most attractive binding according to the first embodiment, the user should stack in careful registry a plurality of pages 14 to be bound together between two covers 15 and 16. The stacked pages 14 and covers 15 and 16 can then be perforated with an appropriate punch producing a row of rectangular apertures 17 shaped to receive said bands 3 along the edge of the pages 14 and covers 15 and 16 to be bound, and the apertures 17 are approximately as wide as the bands 3 of the blank 1 and spaced to align with the bands 3 of the blank 1. To bind the covers 15 and 16 and pages 14 so that the tape 2 is not visible, the pages 14 and covers 15 and 16 should be stacked with the back cover 16 next to the front cover 15 and the outside surfaces of the covers 15 and 16 immediately adjacent one another, and with the pages 14 stacked on the inside of the front cover 15. Next, the bands 3 of the blank 1 are inserted through the aperture 17 in the pages 14 and covers 15 and 16. Then the portions of the liner 6 covering the pressure sensitive adhesive 5 between the ends of the bands 3 and the apertures 8 and the tape 2 are removed and the bands 3 are folded over with their ends projecting through the apertures 8 the distance indicated by the transverse guide lines 9 or 10 or 11 or 12 projecting through the apertures 8 to produce the predetermined band ring 13 size that is optimal for the size of the stack of pages 14 with covers 15 and 16. When this is completed, and all of the band rings 13 have been formed, the remainder of the liner strip 6 is removed exposing all of the pressure sensitive adhesive 5 on the inner surface of the tape 2 and the tape 2 is folded over on itself along its perforated central fold line 7, completely covering the pressure sensitive adhesive 5 and the ends of the band rings 13. Finally, the unused end portions 18 of the bands 3 projecting through the apertures 8 are cut off with a scissors, and the back cover 16 is folded over against the back page with a folded tape 2 between the back cover and the back page as can be seen in FIG. 6 so that the binding on the closed book appears only as a plurality of detached, evenly spaced, parallel band rings 13, and the tape 2 is completely covered as is evident in FIG. 5.

From the foregoing the salient advantages and objects of the present invention become evident. In the first place, the only tool required to make the binding is an ordinary scissors, or even a sharp knife would do. No particular skill is required, save some patience and care. The resulting band rings 13 have the appearance of uniform round rings, but on closer examination will be seen to lie flat. Nevertheless the band rings 13 function with the ease of the perfectly round, rigid rings since they readily deform as the paper pages 14 or more rigid covers 15 and 16 are rotated about the completed binding 19. The ability of the bands 13 to deform has numerous advantages, the first of which is mentioned above, to wit: no tools are required to assemble the binding 19, but beyond the ease of assembling there are additional advantages, and a large range of different size rings can be formed from a single blank. Whereas a loose-leaf binder using a rigid plastic ring or a metal spiral requires a box for mailing or storage to insure that the spirals would not become deformed or the rigid rings broken if pinched together, the binding of the present invention may be sent through the mail in an ordinary envelope since the band rings 13 readily deform to lie flat and reform in use and cannot be broken. The cost saving from this feature alone can be monumental.

Figure 7:
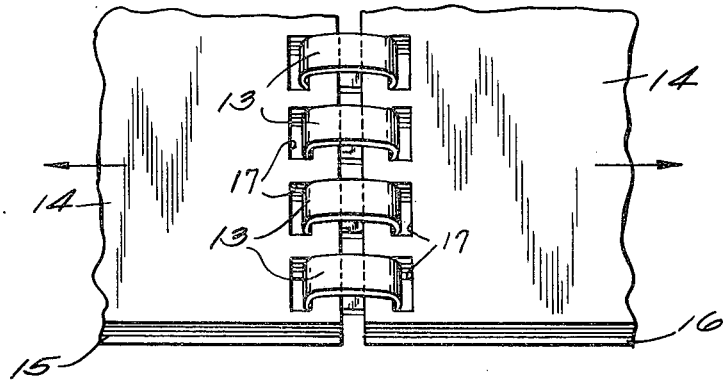
FIG. 7 is an illustration of the bound volume shown in FIGS. 5 and 6 open flat with the pages pulled apart.

Of equal importance is the added strength of the binding as is demonstrated by FIG. 7 in the drawings. If the bound book is opened flat at any place randomly selected, and the two portions of covers 15 and 16 and pages 14 are pulled apart, the band rings 13 flatten out and deform according to the force imposed. If the force imposed is uneven across the length of the apertures 8, the band rings 13 can deform unevenly with the rectangular apertures 17 and at all times to bear across the full width of the band rings 13, instead of producing a point or line contact on either edge of the ring experienced with rigid rings. As a result, it is much more difficult to tear the pages out of a binding of the present invention than it is to tear the pages from a rigid ring binding, simply because the tearing force is distributed over a much broader area.

While the material used in the preferred embodiment and in the present commercial embodiment is polyethylene terephthalate, or "Mylar", that material is mentioned here only to exemplify the properties of a material desirable for use in the band rings 13 of the present invention. Doubtless numerous other materials and fabrics exist that have sufficiently similar properties for use in carrying out the invention. While the material for the bands 13 should be supple and resist creasing, ideally it should also have sufficient rigidity to be easily threaded through apertures 17 in a stack of pages 14 manually, if the invention is to be used with a minimum number of tools by persons having no previous experience or practice or skills. However, jigs may be devised to aid in threading, just as jigs may be devised to aid in ring 13 formation.

A flexible binder 20 of a second embodiment, which is illustrated in FIG. 8, is die-cut as a single piece from a sheet of 0.010 gauge, polyethylene terephthalate or clear, "Mylar". The die-cut flexible binder 20 has a tape 21 with a plurality of equally spaced bands 22 projecting perpendicularly from one edge 23. Opposite each band 22 and located approximately on and aligned with the longitudinal center axis of the tape 21 is a rectangular aperture 24 that is somewhat longer than the band 22 is wide so that the band 22 may easily be threaded through it. At spaced intervals along both edges 25 and 26 of each band 22, notches or serrations 27 and 28, respectively, are formed so that the serrations 27 and 28 are aligned in opposite pairs. The ends or deepest points of the serrations 27 and 28 may be referred to as roots 31 and 32 of the serrations 27 and 28. In another edge 29 of the tape 21 and aligned with each band 22 and aperture 24 a deep notch 30 is formed with a flared mouth 31. The notches 30 are approximately as wide as each narrow neck 33 of the bands 22 between the roots 31 and 32 of the pairs of serrations 27 and 28.

To use the second embodiment, the bands 22 are threaded through holes 34 through paginally stacked front and back covers 35 and 36 and pages 37 between the covers 35 and 36. Preferably, for appearance, the bands 22 are threaded through the holes 34 so that the tape 21 is inside the back cover 36. The bands 22 are then folded back toward the tape 21 and threaded through their respective apertures 24 in the tape 21. Then one of the narrow necks 31 of the band 22 is slid into its corresponding notch 30 far enough so that the sides of the serrations 27 and 28 grip the sides of the notch 30 and form closed band rings 38. To remove pages 37 or to add more pages 37, the bands 22 are slid out of the notches 30 and drawn through the apertures 24 opening the band rings 38.

In summary, the present invention provides a binder that may have the permanence and strength of a sewn binding or the ability of a ring notebook to be opened and closed, and the flexibility of a ring binder in allowing the pages to lie flat and in addition has a very thin backbone which allows the pages to be turned through nearly a full circle. Also, the present invention provides a binder that is nearly indestructable and requires no more space than a sewn binding and one blank can be used on different books that vary widely in thickness. The binder embodying the present invention can be produced manually in the home without extra tools, or it can be mass produced in a factory, both at minimum cost. In short, the present invention combines the advantages of the sewn or perfect binding with the advantages of the rigid ring and spiral bindings together with the simplicity and low cost of a stapled binding. As an alternative to a permanent binding, the present invention can also be embodied in an openable binding like a ring notebook. As will be readily evident from the invention as revealed through the detailed description of the foregoing preferred embodiments, numerous other embodiments suggest themselves in which the invention may be practiced, and manifestly the invention, therefore, is not confined to the preferred embodiment, but is set forth in the claims that follow.

I claim:

1. A method for making a flexible loose leaf binding for a book comprising the steps of:

preparing a stack of pages having a row of holes along one edge of said stack extending through said stack;

positioning along said edge of the stack a tape having a preferential fold line extending along a longitudinal axis thereof and a plurality of band-receiving apertures through it along said fold line;

threading a like plurality of bands of flexible, supple material having high tensile strength through said holes;

folding said bands to join the ends of each of said bands together to form a plurality of band rings of substantially uniform size and passing the excess length of bands through said band-receiving apertures so that such excess length can be severed; and bonding said joined ends of said plurality of bands together within the folded tape to form a flexible binding.

2. A flexible binder for stacks of sheets, which binder may be readily opened to add or subtract sheets and reclosed, said binder comprising:

an elongated tape of flexible material to extend along an edge of the sheets to be bound together; and a plurality of spaced apart, elongated, flexible bands integrally connected to said tape and projecting perpendicularly from one longitudinal edge;

each of said bands having a plurality of pairs of aligned serrations formed in its opposite lateral edges proximal to its free end to form narrow necks in said band;

said tape having an elongated aperture centrally located opposite each of said bands, said elongated aperture being longer than the width of said band so as to receive said band therethrough;

said tape also having a notch formed in another longitudinal edge opposite said one longitudinal edge and located in alignment with each of said bands, said notch being approximately as wide as said narrow necks in said band;

each of said bands being of sufficient length so that the free end thereof can extend through an aperture in said sheets and be folded back against itself, passed through an aperture centrally located opposite to said band and be positioned so that a narrow neck in said band can be slid into said notch located in alignment with said band to form a closed ring band which may be readily opened and reclosed to add or subtract sheets from said binder.

3. A flexible binder for a plurality of stacked sheets comprising the combination of:

a. a tape of flexible, supple material to extend along an edge of the sheets to be bound together, said tape being provided with a preferential fold line extending along a longitudinal axis thereof, and at least one band-receiving aperture through it along said preferential fold line;

b. at least one band to project transversely of said tape from one edge of said band with a free end of sufficient length to pass through an aperture in a stack of sheets and to be folded back against itself to join the ends of said band to form a closed band ring in such a manner that any excess length of the free end of said band extends through said band-receiving aperture and can be severed, said band having at least one guide marker at a precalculated distance from the free end of said band; so that when it is desired to form a band ring of a certain size, said band is folded over and inserted through the aperture in said tape until the guide mark is viewed from said aperture at which time the guide marker no longer serves any purpose and can be severed; and c. bonding means for bonding the joined ends of said band ring within the tape folded along said preferential fold line.

4. A flexible binding as set forth in claim 3 wherein said band is contiguous with said tape.

5. A flexible binding as set forth in claim 3 wherein said tape and said band are cut from a single sheet of flexible, supple material of high tensile strength.

* * * * *